US011022924B2

(12) United States Patent
Kasuga

(10) Patent No.: US 11,022,924 B2
(45) Date of Patent: Jun. 1, 2021

(54) IMAGE FORMING APPARATUS FOR DETERMINING COLOR OF TONER ADHERED TO NON-IMAGE REGION

(71) Applicant: CANON KABUSHIKI KAISHA, Tokyo (JP)

(72) Inventor: Kuniaki Kasuga, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/065,431

(22) Filed: Oct. 7, 2020

(65) Prior Publication Data

US 2021/0116851 A1 Apr. 22, 2021

(30) Foreign Application Priority Data

Oct. 18, 2019 (JP) ..... JP2019-191154
Jun. 10, 2020 (JP) ..... JP2020-101078

(51) Int. Cl.
*G03G 15/00* (2006.01)

(52) U.S. Cl.
CPC ..... *G03G 15/5062* (2013.01); *G03G 2215/00063* (2013.01); *G03G 2215/00067* (2013.01)

(58) Field of Classification Search
CPC ..... G03G 15/5062; G03G 2215/00063; G03G 2215/00067
See application file for complete search history.

(56) References Cited

U.S. PATENT DOCUMENTS

2010/0215384 A1* 8/2010 Yasutomi ..... G03G 15/2039 399/15

FOREIGN PATENT DOCUMENTS

| | | | |
|---|---|---|---|
| JP | 2010122870 | A | 6/2010 |
| JP | 2014224968 | A | 12/2014 |
| JP | 2017226074 | A | 12/2017 |
| JP | 2018112636 | A | 7/2018 |

* cited by examiner

*Primary Examiner* — Susan S Lee
(74) *Attorney, Agent, or Firm* — Canon U.S.A., Inc., IP Division

(57) ABSTRACT

An image forming apparatus includes: a control unit configured to acquire base information by making a reading unit read a surface of the recording material with all image forming units set in a non-forming state, acquire first determination information by making the reading unit read a non-image region of the recording material with only a first image forming unit set in a forming state, and acquire second determination information by making the reading unit read the non-image region with all image forming units set in the forming state or with only all second image forming units set in the forming state. The control unit is further configured to determine a color of a toner adhered to the non-image region based on the base information, the first determination information, and the second determination information.

27 Claims, 10 Drawing Sheets

IMAGE FORMING APPARATUS FOR DETERMINING COLOR OF TONER ADHERED TO NON-IMAGE REGION

BACKGROUND OF THE INVENTION

Field of the Invention

The present invention relates to an image forming apparatus that forms an image via electrophotography, such as a copy machine, a printer, and a facsimile machine.

Description of the Related Art

In an image forming apparatus that uses electrophotography, fogging may occur. Fogging is a phenomenon where toner adheres to a non-image region where toner should not adhere to. Japanese Patent Laid-Open No. 2018-112636 discloses a configuration for detecting fogging. Specifically, Japanese Patent Laid-Open No. 2018-112636 discloses detecting fogging by reading and comparing a density of a non-image region of a top surface where an image is formed and a density (base density) of a back surface where an image is not formed. Also, US-2010-123914 discloses a configuration for determining the color of the toner causing fogging by reading the color of the fogging using a reading device.

However, in the case in which a transfer member is smeared with toner, the toner is transferred from the transfer member to the back surface of a recording material, and the base density cannot be accurately acquired. In such cases, the configuration disclosed in Japanese Patent Laid-Open No. 2018-112636 cannot accurately determine the occurrence of fogging. Also, in the configuration disclosed in Japanese Patent Laid-Open No. 2018-112636, to prevent a toner image formed on the top surface being affected, density information of the back surface corresponding to the non-image region of the top surface must be acquired. In other words, when base density of the back surface is acquired, the non-image region of the top surface must be identified, making control complicated.

Also, the colors detected by the reading device are normally different from the colors used in image forming by the image forming apparatus. For example, the image forming apparatus forms images using yellow (Y), magenta (M), cyan (C), and black (K) toner, and the reading device detects red (R), green (G), and blue (B) color information. Thus, in the configuration described in US-2010-123914, the RGB color values read by the reading device must be converted to YMCK. However, in the case in which fogging occurs with a plurality of color toners, in other words, in the case in which the color of the fogging is mixed, depending on the color, the fogging may be determined to be caused by only the black toner. This means that the color of the fogging may be unable to be accurately identified.

SUMMARY OF THE INVENTION

According to an aspect of the present disclosure, an image forming apparatus includes: a plurality of image forming units including a first image forming unit configured to form an image by using a toner of a first color, and a plurality of second image forming units configured to form an image by using toners of a plurality of second colors which are different from one another, wherein the plurality of image forming units are capable of being set in a non-forming state in which an image is not formed or a forming state in which an image is formed; a reading unit configured to read a surface of a recording material having passed an image forming position where an image is able to be formed on the recording material; and a control unit configured to perform control to acquire base information, which is obtained by making the reading unit read the surface of the recording material with all of the plurality of image forming units set in the non-forming state, acquire first determination information, which is obtained by making the reading unit read a non-image region of the recording material with only the first image forming unit set in the forming state, and acquire second determination information, which is obtained by making the reading unit read the non-image region of the recording material with all of the plurality of image forming units set in the forming state or with only all of the plurality of second image forming units set in the forming state, wherein the control unit is further configured to determine a color of a toner adhered to the non-image region of the recording material based on the base information, the first determination information, and the second determination information.

Further features of the present invention will become apparent from the following description of exemplary embodiments with reference to the attached drawings.

DESCRIPTION OF THE EMBODIMENTS

Figure 1:
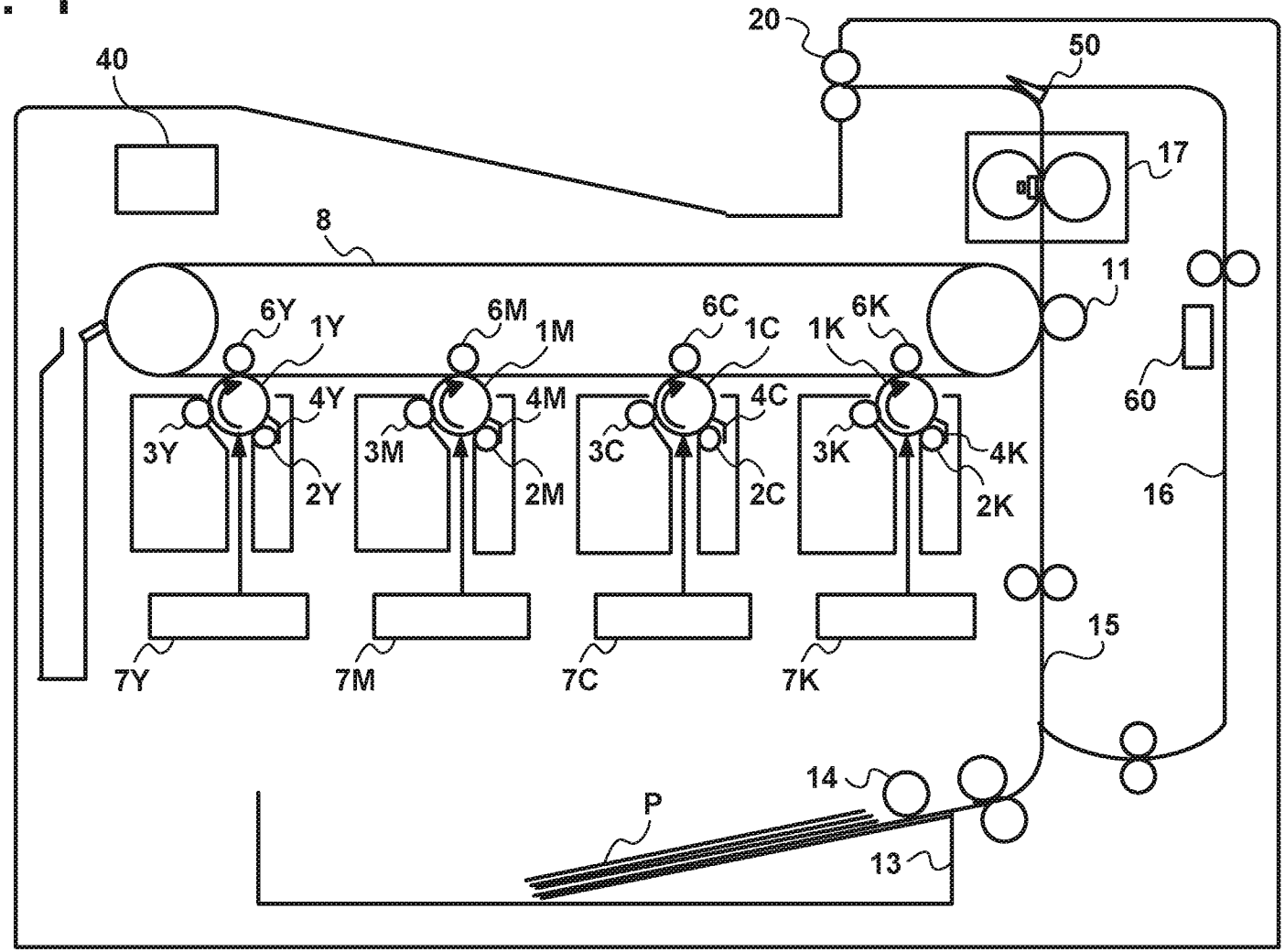
FIG. 1 is a configuration diagram of an image forming apparatus according to an embodiment.

Hereinafter, embodiments will be described in detail with reference to the attached drawings. Note, the following embodiments are not intended to limit the scope of the claimed invention. Multiple features are described in the embodiments, but limitation is not made an invention that requires all such features, and multiple such features may be combined as appropriate. Furthermore, in the attached drawings, the same reference numerals are given to the same or similar configurations, and redundant description thereof is omitted.

First Embodiment

FIG. 1 is a configuration diagram of an image forming apparatus of the present embodiment. In FIG. 1, the letters Y, M, C, and K affixed to the end of the reference signs indicate the color, respectively, yellow, magenta, cyan, and black, of the toner image that the member denoted by the reference sign is involved in forming. However, when the color is not required to be distinguished in the following description, the reference sign is used without the affixed letter. A photosensitive member 1 is rotationally driven in the clockwise direction of the drawing when forming an image. A charging roller 2 charges the surface of a corresponding photosensitive member 1 to a uniform electric potential by outputting a charging bias voltage. An exposure device 7 forms an electrostatic latent image on the corresponding photosensitive member 1 by exposing the photosensitive member 1 to light. A developing roller 3 of a developing unit adheres toner to and develops the electrostatic latent image of the photosensitive member 1 by outputting a developing bias voltage and in this way forms a toner image on the photosensitive member 1. Note that the developing roller 3 is capable of being set in a contact state abutted against or contacted with the photosensitive member 1 and a separated state separated from the photosensitive member 1. When developing, the developing roller 3 is set in the contact state. A primary transfer roller 6 transfers the toner image of the corresponding photosensitive member 1 to an intermediate transfer belt 8 by outputting a primary transfer bias voltage. Note that the primary transfer roller 6 is capable of being set in a contact state abutted against or contacted with the intermediate transfer belt 8 and a separated state separated from the intermediate transfer belt 8. When the toner image of the photosensitive member 1 is transferred to the intermediate transfer belt 8, the primary transfer roller 6 is set in the contact state. A cleaner 4 removes the toner not transferred to the intermediate transfer belt 8 remaining on the photosensitive member 1. Note that the corresponding photosensitive member 1, developing roller 3, charging roller 2, and cleaner 4 are stored inside a cartridge and are able to be detached from the main body of the image forming apparatus. Also, for example, the corresponding photosensitive member 1, charging roller 2, exposure device 7, developing roller 3, and primary transfer roller 6 function as an image forming unit that forms an image on the intermediate transfer belt 8. The image forming apparatus of the present embodiment forms an image using one toner of an achromatic color (black) and a plurality of toners of chromatic colors (yellow, magenta, and cyan).

The intermediate transfer belt (intermediate transfer member) 8 is rotationally driven in the anticlockwise direction of the drawing when forming an image. A full color toner image can be formed on the intermediate transfer belt 8 by transferring the toner images formed on each photosensitive member 1 in an overlapping manner on the intermediate transfer belt 8. The toner image transferred to the intermediate transfer belt 8 is conveyed to an opposing position of a secondary transfer roller 11 via the rotation of the intermediate transfer belt 8. A recording material P stored in a cassette 13 is fed to a conveyance path 15 by a feeding roller 14. The recording material P is conveyed to the opposing position of the secondary transfer roller 11 by rollers provided along the conveyance path 15. The secondary transfer roller 11 transfers the toner image of the intermediate transfer belt 8 to the recording material P by outputting a second transfer bias voltage. In this way, the position where the secondary transfer roller 11 opposes the intermediate transfer belt 8 is an image forming position where an image is formed on the recording material P. After the toner image is transferred, the recording material P is conveyed to a fixing device 17. The fixing device 17 applies heat and pressure to the recording material P to fix the toner image to the recording material P. When the process involving the recording material P has finished and the toner image has been fixed, the recording material P is discharged outside of the image forming apparatus by a discharge roller 20. When the process involving the recording material P has not finished, such as when an image is formed on both sides of the recording material P, the recording material P is conveyed to a both-surface conveyance path 16. When the recording material P is conveyed to the both-surface conveyance path 16, first, the recording material P is conveyed in a discharge direction by the discharge roller 20. Then, when a trailing end of the recording material P passes a flapper 50, the discharge roller 20 is rotated in the reverse direction and the recording material P is conveyed toward the both-surface conveyance path 16. Note that at this time, the flapper 50 is orientated to guide the recording material P to the both-surface conveyance path 16. In the case in which an image is to be formed on both sides of the recording material P, the recording material P, via the both-surface conveyance path 16, is once again conveyed to the conveyance path 15 and an image is formed on the other surface.

Figure 2:
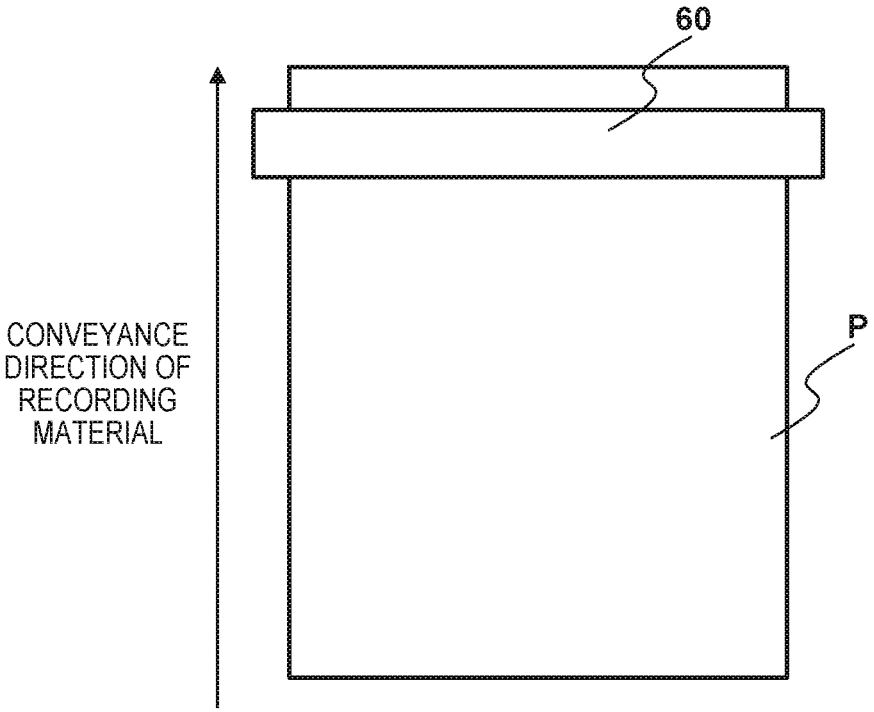
FIG. 2 is a diagram illustrating a reading unit according to an embodiment.

Also, in the case in which an image of the recording material P is to be read, the recording material P is conveyed to the both-surface conveyance path 16. A reading unit 60 reads an image of the recording material P conveyed to a read position on the both-surface conveyance path 16. The reading unit 60 includes a non-illustrated light-emitting element and a contact image sensor (CIS), which is a density sensor. As illustrated in FIG. 2, the reading unit 60 uses a plurality of pixels (not illustrated) disposed in the width direction orthogonal to the conveyance direction of the recording material P to acquire color information at a plurality of positions of the top surface of the recording material P corresponding to the plurality of pixels. Note that the reading unit 60 reads red (R), green (G), and blue (B) color values as the color information. The reading unit 60 reads the recording material P a number of times as the recording material P is passing through the reading position of the reading unit 60. This allows the reading unit 60 to read the entire image on the top surface of the recording material P. The reading unit 60 outputs an image signal indicating the read color values of the pixels to a control unit 40. The control unit 40 controls the entire image forming apparatus.

Figure 8A:
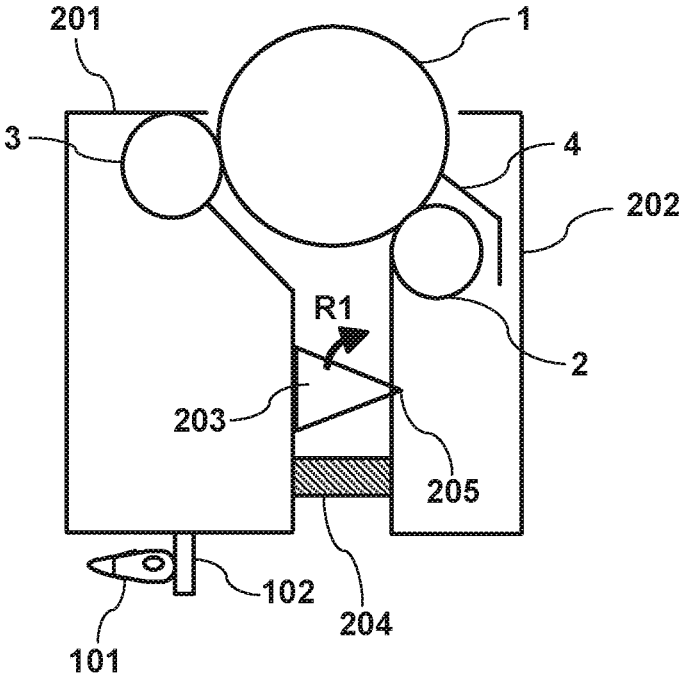
FIGS. 8A and 8B are explanatory diagrams of an abutment and separation mechanism of a developing roller according to an embodiment.
Figure 8B:
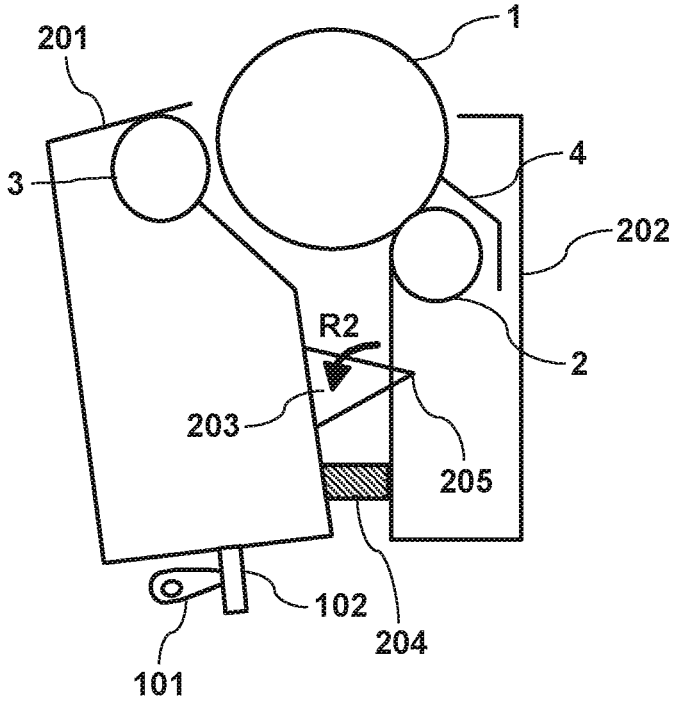
Figure 9:
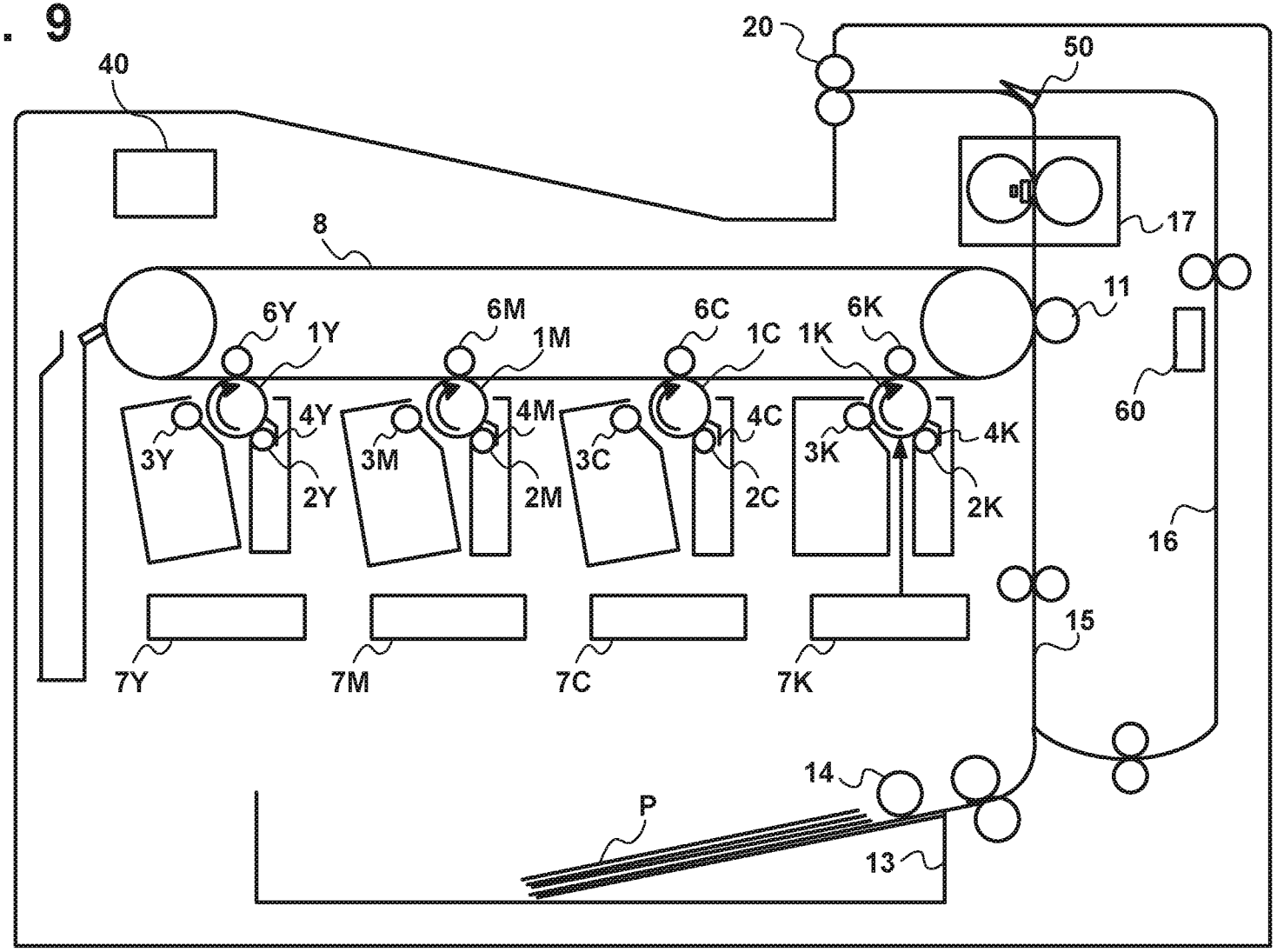
FIG. 9 is a diagram illustrating an image forming apparatus with one developing roller set in a contact state and the other developing rollers set in a separated state.

FIG. 8A illustrates the developing roller 3 in the contact state. FIG. 8B illustrates the developing roller 3 in the separated state. A first frame body 201 supports the developing roller 3, and a second frame body 202 supports the photosensitive member 1, the charging roller 2, and the like. Note that the first frame body 201 is turnably coupled to the second frame body 202 by a turning arm 203. Also, the first frame body 201 is provided with a projection 102. Furthermore, a compression coil spring 204 is disposed between the first frame body 201 and the second frame body 202. As illustrated in FIG. 8A, via the biasing force of the compression coil spring 204, the first frame body 201 turns in the direction of arrow R1 round a fulcrum 205 of the turning arm 203, putting the developing roller 3 in the contact state abutting against the photosensitive member 1. Also, a cam 101 provided on the body of the image forming apparatus is driven by a non-illustrated drive motor. As illustrated in FIG. 8B, when the projection 102 is pushed by the cam 101 to the right side of the drawing, the first frame body 201 turns in the direction of arrow R2. This sets the developing roller 3 in the separated state separated from the photosensitive member 1. FIG. 9 illustrates a state in which the developing rollers 3Y, 3M, and 3C are set in the separated state and the developing roller 3K is set in the contact state.

To determine the presence of fogging, base information, which is color information of the base (underlayer) of the recording material P, is needed. Thus, when a print job (hereinafter, simply referred to as job) is received and a predetermined condition is satisfied, the control unit 40 acquires the base information. Note that the base information is acquired during the preparation period spanning from after receiving a job to when the exposure device 7 and the fixing device 17 are activated and ready to print.

Figure 3:
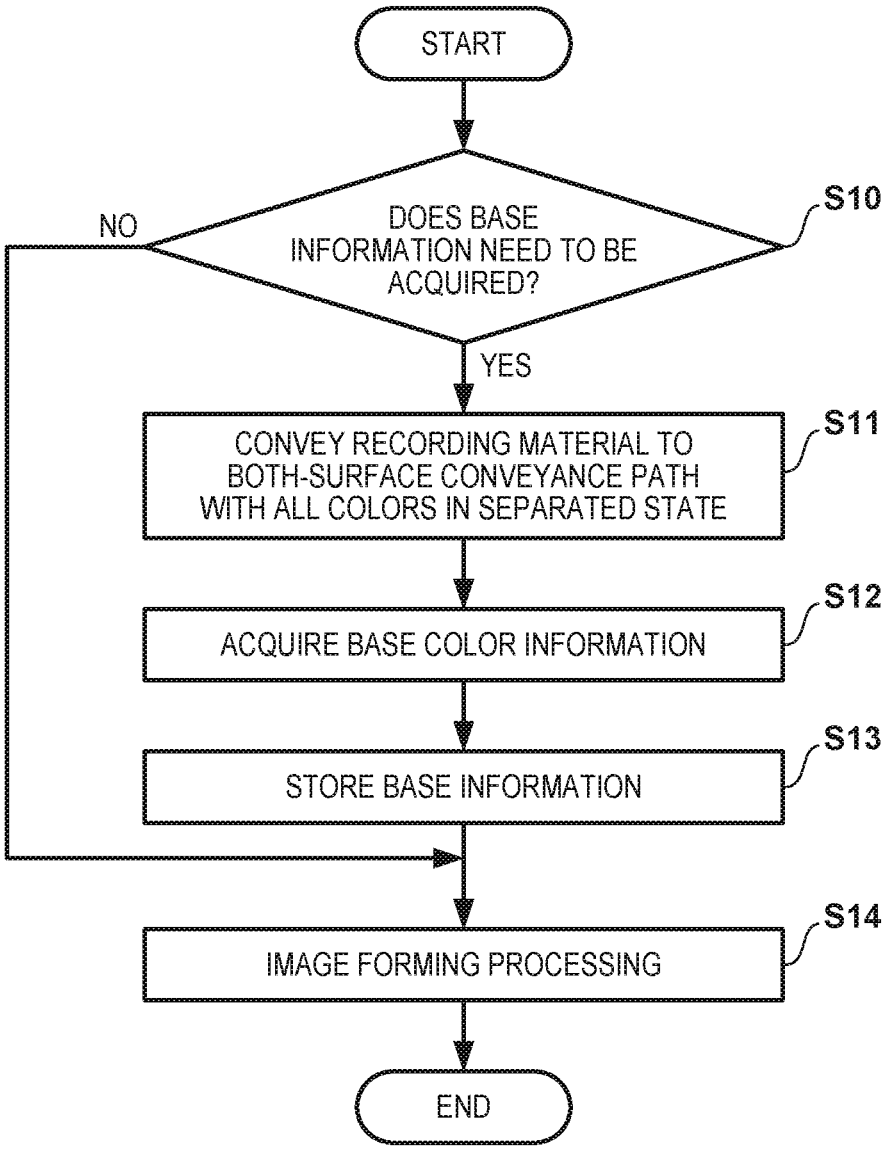
FIG. 3 is a flowchart of processing when a print job is received according to an embodiment.

FIG. 3 is a flowchart of the processing executed by the control unit 40 during the preparation period after receiving a job. In step S10, the control unit 40 determines whether or not base information needs to be acquired. Note that as described above, the control unit 40 determines that base information needs to be acquired in the case in which the predetermined condition is satisfied and determines that base information does not need to be acquired in the case in which the predetermined condition is not satisfied. The presence of fogging is determined by comparing the color information of the non-image region of the recording material P on the same surface of the recording material P on which the image is formed and the base information of the recording material P. Thus, the base information is preferably acquired after the period of time during which the type of recording material P stored in the cassette 13 can be changed. In this way, for example, the control unit 40 can be configured to determine to execute base information acquisition for the first job received after detecting a user operation of opening or closing the cassette 13, which is a user operation relating to the user being able to change the type of recording material P. Also, the control unit 40 can be configured to determine to execute base information acquisition for the first job received after the image forming apparatus is powered on.

In the case in which base information acquisition processing is not executed, in step S14, the control unit 40 executes the image forming processing described below. On the other hand, in the case in which base information acquisition processing is executed, in step S11, the control unit 40 sets all of the developing rollers 3 to the separated state and conveys the recording material P to the both-surface conveyance path 16. In step S12, the control unit 40 makes the reading unit 60 read the color information of the top surface (base) of the recording material P. Note that the region of the recording material P read in step S12 may be the entire region of the recording material P or may be a predetermined region of the recording material P. The control unit 40 obtains the average value of the color values of the pixels in the region of the recording material P read in step S12. Hereinafter, the average values of the red, green, and blue pixels in the region read in step S12 are referred to as $R_0$, $G_0$, and $B_0$, respectively. In step S13, the control unit 40 stores the base information ($R_0$, $G_0$, $B_0$) into a non-illustrated memory. Then, the recording material P is conveyed to the conveyance path 15 for image forming via the image forming processing of step S14 described below.

Figure 4:
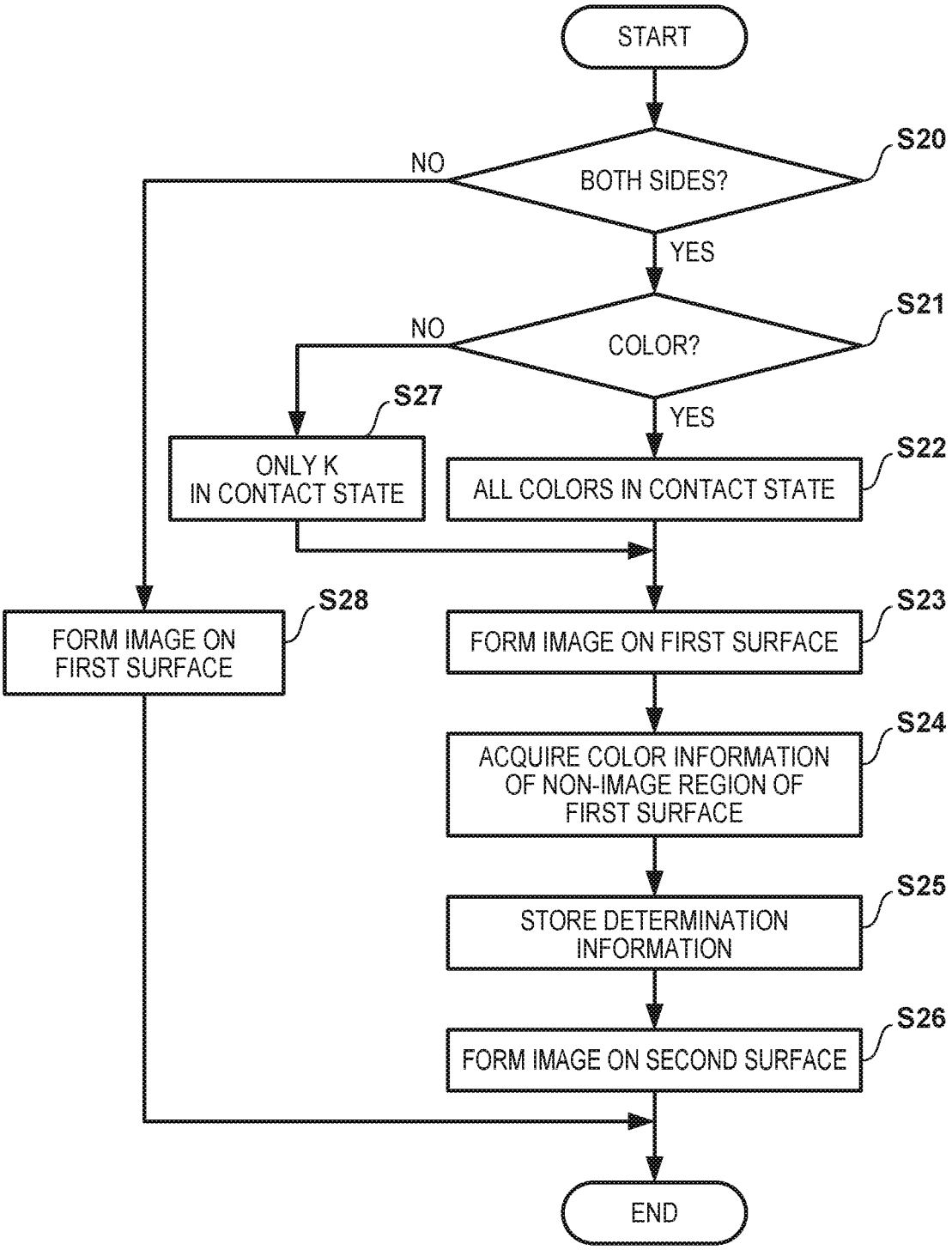
FIG. 4 is a flowchart of image forming processing according to an embodiment.

FIG. 4 is a flowchart of the image forming processing of step S14 listed in FIG. 3. In step S20, the control unit 40 determines whether the received job is a job for forming an image on both sides of the sheet (hereinafter, referred to as a both side job) or whether the received job is a job for forming an image on one side (hereinafter, referred to as a one side job). Note that hereinafter, the surface of the recording material P where the image is first formed is referred to as a first surface, and the surface of the recording material P where the image is formed after the first surface is referred to as a second surface. In the case of a one side job, in step S28, the control unit 40 forms an image on the first surface of the recording material P, and the process of FIG. 4 ends. In the case of a both side job, in step S21, the control unit 40 determines whether the received job is a job for forming a color image (hereinafter, referred to as a color job) or whether the received job is a job for forming a monochrome image (hereinafter, referred to as a monochrome job). In the case of a color job, the control unit 40, in step S22, sets all of the developing rollers 3 to the contact state and, in step S23, forms an image on the first surface of the recording material P. In the case of a monochrome job, the control unit 40, in step S27, sets only the black developing roller 3K to the contact state and the other developing rollers 3Y, 3M, and 3C to the separated state and, in step S23, forms an image on the first surface of the recording material P.

Figure 5:
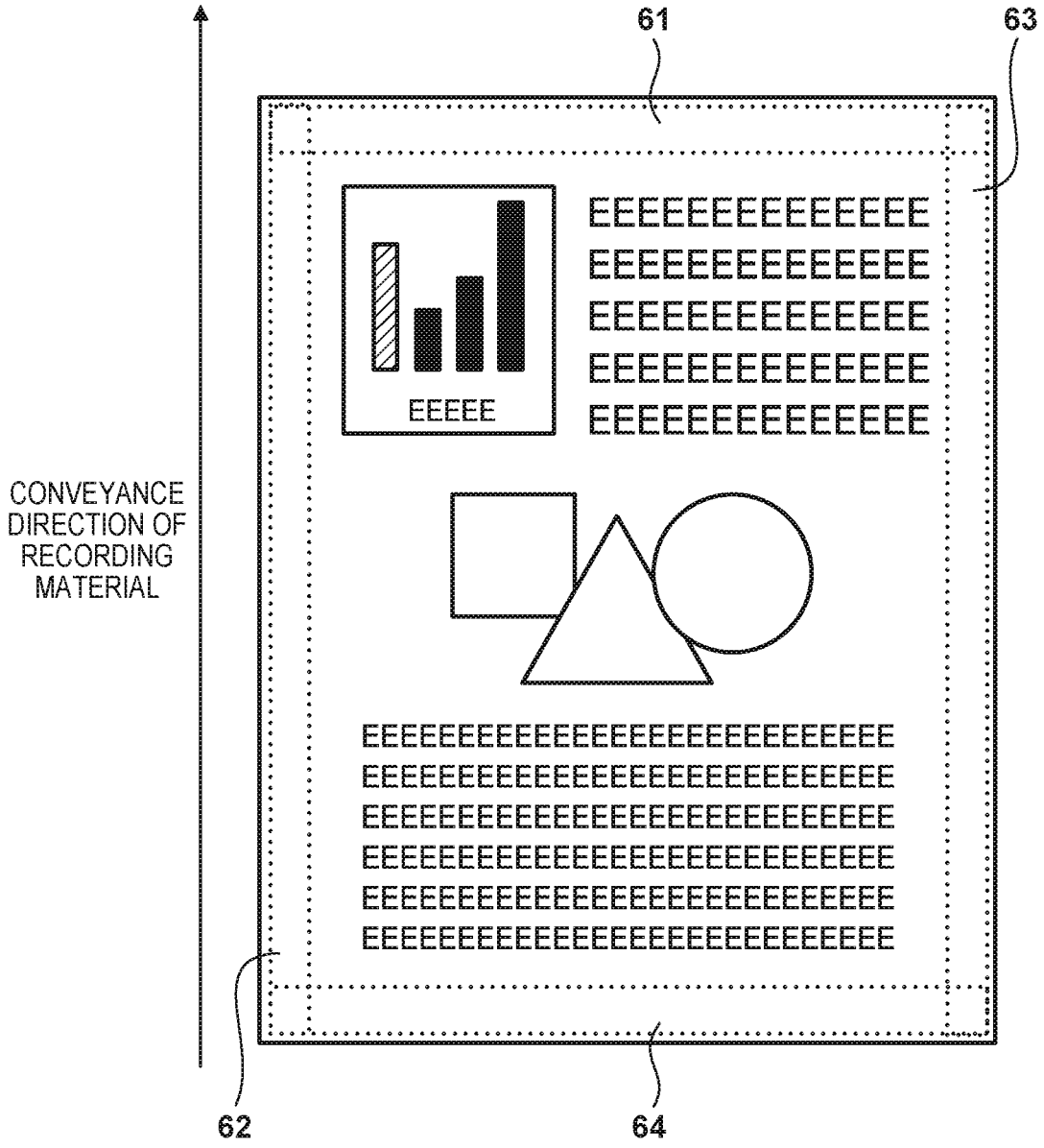
FIG. 5 is a diagram illustrating a non-image region used in acquiring determination information according to an embodiment.

After an image is formed on the first surface, the control unit 40 conveys the recording material P to the both-surface conveyance path 16 and, in step S24, makes the reading unit 60 read the color information of the non-image region of the first surface of the recording material P. The read non-image region can be set to a discretionary region on the recording material P where the toner should not adhere to. However, as illustrated in FIG. 5, for example, one or more regions from margin regions 61, 62, 63, and 64 that become the non-image region regardless the image pattern to be formed on the recording material P may be read. Alternatively, a configuration may be employed in which, after the entire region of the recording material P is read, the information read from one or more of the margin regions 61, 62, 63, and 64 is used in processing that follows.

The control unit 40 obtains the average value of the color values of the pixels in the non-image region read in step S24 for each color. Hereinafter, in the case of forming a color image, the average values of the red, green, and blue pixels in the non-image region read in step S24 are referred to as $R_C$, $G_C$, and $B_C$, respectively. In a similar manner, in the case of forming a monochrome image, the average values of the red, green, and blue pixels in the non-image region read in step S24 are referred to as $R_M$, $G_M$, and $B_M$, respectively. In step S25, the control unit 40 stores the determination information ($R_C$, $G_C$, $B_C$) or ($R_M$, $G_M$, $B_M$) into the non-illustrated memory. Note that hereinafter, ($R_C$, $G_C$, $B_C$) is referred to as color determination information, ($R_M$, $G_M$, $B_M$) is referred to as monochrome determination information, and these are collectively referred to as determination information. After the determination information is stored, in step S26, the control unit 40 forms an image on the second surface of the recording material P.

When the determination information is acquired, the control unit 40 executes the fogging determination processing described below. In the fogging determination processing, the most recent color determination information, the most recent monochrome determination information, and the most recent base information are used. Note that the fogging determination processing includes occurrence determination processing, which determines whether or not fogging unacceptable in terms of image quality is occurring, and color determination processing, which determines the color of the toner causing fogging in the case in which fogging is determined to be occurring.

First, the occurrence determination processing will be described. The control unit 40 first determines a color difference $dE_c$ between the color determination information and the base information. The color difference $dE_c$ is the Euclidean distance in RGB space and is determined using Formula (1) below.

$$dE_c=\sqrt{((R_c-R_0)^2+(G_c-G_0)^2+(B_c-B_0)^2)} \quad (1)$$

The color difference $dE_c$ indicates the density of the fogging caused by all of the toners and is a value correlating to the fogging toner amount adhered to the recording material P. Thus, in the present embodiment, when the color difference $dE_c$ is greater than a first threshold, fogging is determined to be occurring, and when the color difference $dE_c$ is less than the first threshold, fogging is determined to not be occurring. When the color difference $dE_c$ equals to the first threshold, it is possible to determine that fogging occurs or it is possible to determine that fogging does not occur. With the R, G, B color values represented by 8 bits (from 0 to 255), the first threshold is 10, for example. Note that in the present embodiment, "fogging is occurring" means that fogging unacceptable in terms of image quality is occurring. In other words, in the present embodiment, a determination that fogging is not occurring does not mean that zero fogging is occurring and means that fogging unacceptable in terms of image quality is not occurring. Also, the control unit 40 determines higher values of the color difference $dE_c$ as representing fogging of higher degrees (higher density of fogging).

In the case in which fogging is determined to be occurring, the control unit 40 executes the color determination processing. The color determination processing includes a first determination processing and a second determination processing. In the first determination processing, the control unit 40 determines whether the fogging is mainly caused by the black (achromatic color) toner or by a chromatic color toner. The second determination processing is executed in the case in which the fogging is determined to be mainly caused by a chromatic color toner in the first determination processing. In the second determination processing, the control unit 40 determines whether the fogging is mainly caused by the yellow toner, caused by the magenta toner, or caused by the cyan toner.

First, the first determination processing will be described. The control unit 40 determines a color difference $dE_m$ between the monochrome determination information and the base information. In a similar manner to the color difference $dE_c$, the color difference $dE_m$ is determined using Formula (2) below.

$$dE_m=\sqrt{((R_m-R_0)^2+(G_m-G_0)^2+(B_m-B_0)^2)} \quad (2)$$

The color difference $dE_m$ indicates the density of the fogging caused by only the black toner. In the case in which the color difference $dE_m$ is greater than a second threshold, the black toner is determined to be the predominant cause of the fogging. Note that the second threshold is a value half of the first threshold, for example. For example, with the R, G, B color values represented by 8 bits (from 0 to 255), the first threshold may be set to 10 and the second threshold may be set to 5. On the other hand, in the case in which the color difference $dE_m$ is less than or equal to the second threshold, a toner other than the black toner is determined to be the predominant cause of the fogging. In this case, the control unit 40 executes the second determination processing described below.

In the second determination processing, the color determination information, the monochrome determination information, and reference information are used. Here, the color determination information and the monochrome determination information are the most recent color determination information and the most recent monochrome determination information at the point in time when determination is executed. The reference information will be described later. As the color determination information and the monochrome determination information are device-dependent RGB information, the RGB information is converted to the non-device dependent L*a*b* color space. The R, G, B color values are converted to L*, a*, b* color values by a known method. Hereinafter, the color determination information in the L*a*b* color space, converted from the color determination information ($R_c$, $G_c$, $B_c$) in the RGB color space, is referred to as ($L^*_c$, $a^*_c$, $b^*_c$). In a similar manner, the monochrome determination information in the L*a*b* color space, converted from the monochrome determination information ($R_m$, $G_m$, $B_m$) in the RGB color space, is referred to as ($L^*_m$, $a^*_m$, $b^*_m$). Note that, because the color information in the L*a*b* color space is used in the second determination processing, as described below, "color space" and "color information" refer to the L*a*b* color space and the color information in the L*a*b* color space, unless another color space is specifically mentioned.

The reference information will now be described. The reference information is color information of the yellow, magenta, and cyan toner and is measured beforehand and stored in the non-illustrated memory of the control unit 40. For example, a yellow, magenta, and cyan single color image are formed on the recording material P and read by the reading unit 60. Then, color information in RGB color space is acquired. Next, the base color information of the recording material P is substracted from the acquired color information in the RGB color space, and the resultant values are converted in color information in the L*a*b* color space to acquire the reference information. Hereinafter, the yellow reference information is referred to as $Y_r=(L^*_{Yr}, a^*_{Yr}, b^*_{Yr})$, the magenta reference information is referred to as $M_r=(L^*_{Mr}, a^*_{Mr}, b^*_{Mr})$, the cyan reference information is referred to as $C_r=(L^*_{Cr}, a^*_{Cr}, b^*_{Cr})$. Examples include:

$$Y_r=(-0.5510,-0.1200,+0.9912) \quad (3)$$

$$M_r=(-0.4809,+0.8760,-0.0367) \quad (4)$$

$$C_r=(-0.4702,-0.5676,-0.6758) \quad (5).$$

Note that the reference information $Y_r$, $M_r$, and $C_r$ are color vectors in a color space and, hereinafter, may be referred to as reference vectors.

The control unit 40 first determines a differential vector $D_k$ using Formula (6) below by subtracting a vector in the color space corresponding to the monochrome determination information from a vector in the color space corresponding to the color determination information.

$$D_k=(L^*_k,a^*_k,b^*_k)=(L^*_c-L^*_m,a^*_c-a^*_m,b^*_c-b^*_m) \quad (6)$$

The differential vector $D_k$ is determined by the color of the black component of the fogging and the color of the base being subtracted from the color determination information indicating the color of the fogging and the color of the base. In other words, the differential vector $D_k$ is color information indicating the color of the fogging caused by the yellow, magenta, and cyan toner.

The control unit 40 calculates the inner products of the differential vector $D_k$ and the reference vectors. Hereinafter, the inner product of the differential vector $D_k$ and the reference vector $Y_r$ is referred to as $S_Y$, the inner product of the differential vector $D_k$ and the reference vector $M_r$ is referred to as $S_M$, the inner product of the differential vector $D_k$ and the reference vector $C_r$ is referred to as $S_C$. For example, the inner product $S_Y$ is determined using Formula (7) below.

$$S_Y = L^*_k \times L^*_{Yr} + a^*_k \times a^*_{Yr} + b^*_k \times b^*_{Yr} \quad (7)$$

The control unit 40 determines the color corresponding to the inner product with the highest value, from among the inner products $S_Y$, $S_M$, and $S_C$, to be the predominant color in the fogging that is occurring. This is because a high inner product means that the directions of the two vectors are close to one another. For example, the differential vector $D_k$= (−0.8350, +0.2410, −0.4950), and, using the reference vectors from Formulas (3) to (5), the inner products $S_Y$, $S_M$, and $S_C$ are the following values.

$S_Y$=−0.4738
$S_M$=+0.6308
$S_C$=+0.5903

In this case, the magenta toner is determined by the control unit 40 to be the predominant cause of fogging. Also, the control unit 40 determines that cyan, having the second highest inner product, is the next predominant color after magenta.

When the control unit 40 determines that fogging is occurring and discerns the predominant color/s, the control unit 40 notifies the user of the occurrence of fogging and the color/s thereof. Note that any notification method may be used. For example, a configuration may be employed in which a notification is displayed on a non-illustrated display unit of the image forming apparatus. Also, for example, in an image forming apparatus configured to notify the user when the cartridge, the service life thereof being set, reaches the end of its service life, the timing of the end of service life notification can be controlled according to the fogging determination result. For example, the service life of the cartridge may be set to a cumulative number of rotations of the rotation body inside the cartridge or to a cumulative number of sheets of the recording material P used for image forming. The image forming apparatus counts the cumulative number of rotations of the rotation bodies or the cumulative number of sheets of the recording material P used for image forming and, when the count value reaches a value corresponding to the service life value, notifies the user that the end of service life has been reached. However, even when the end of service life has been reached, if fogging is not occurring, the timing for the end of service life notification to the user may be delayed by a predetermined value converted from the count value. Alternatively, even when end of service life has not been determined from the count value, if fogging is occurring, the user may be notified of the end of service life.

Also, the degree of fogging can be improved by adjusting an image forming condition. For example, the degree of fogging can be reduced by adjusting the back contrast, which is the difference between the electric potential of a non-exposure region of the photosensitive member 1 and the developing bias voltage output by the developing roller 3. In this way, in the case in which fogging is determined to be occurring, the control unit 40 can change the image forming condition of the determined color and reduce the degree of fogging. Note that, for example, for the image forming condition, a plurality of back contrast correction amounts may be set and, depending on the degree of fogging, one of the correction amounts from the plurality of correction amounts can be selected and used.

In the present embodiment, the developing roller 3 is capable of being set to the separated state or the contact state. Here, for example, by setting the developing roller 3Y to the separated state, the yellow toner is prevented from adhering to the photosensitive member 1Y. In other words, in this state, the yellow toner is prevented from adhering to the recording material P via the photosensitive member 1Y and the intermediate transfer belt 8. By setting the developing roller 3 in the separated state in this manner, the corresponding cartridge or image forming unit can be set to a non-forming state in which toner is prevented from adhering to the recording material P. On the other hand, by setting the developing roller 3 to the contact state, the corresponding cartridge or image forming unit can be set to a forming state in which the image forming unit can form an image.

In the present embodiment, all of the cartridges may be set in the non-forming state and the base information may be acquired. This allows the degree of fogging, i.e., the density of fogging, to be accurately determined. Also, by acquiring the monochrome determination information when an image is formed with the cartridges other than the black color cartridge in the non-forming state, whether or not the black toner is the main cause of the fogging can be accurately determined. Furthermore, in the case in which the black toner is not the main cause of the fogging, the color determination information, the monochrome determination information, and the reference information obtained in advance can be used to accurately determine the color that is the main cause of the fogging. Note that the color determination information is acquired when forming a color image, in other words, when all of the cartridges are set to the forming state.

Also, because the occurrence of fogging and the color that is the main cause of the fogging can be accurately determined, the cartridges can be used until the actual end of service life. Also, the user can be prompted to replace a cartridge that has exceeded its service life and causes the quality of formed images to be degraded. Furthermore, by adjusting the image forming condition relating to the color that is the main cause of the fogging, degradation of the quality of formed images can be prevented.

Note that in the present embodiment, the reading unit 60 is configured to read the recording material P at the read position on the both-surface conveyance path. However, the present invention is not limited to such a configuration. For example, the reading unit 60 can be disposed in a manner so as to read the recording material P at a read position on the conveyance path between the fixing device 17 and the discharge roller 20. In this case, even with one side jobs, the color determination information or the monochrome determination information can be read.

Also, in the present embodiment, the recording material P is read by a single reading unit 60. However, a configuration may be used in which two reading units are used. For example, in the case in which, the determination information is acquired via the image forming processing after the base information is read as per the process of FIG. 3, the surface of the recording material P for which the base information is acquired may be different from the surface of the recording material P for which the determination information is acquired. Thus, for example, in the case in which the density (color) of one surface of the recording material P is different from the density of the other surface, the determination accuracy of fogging is degraded. To prevent a degradation to the determination accuracy, another reading unit may be disposed on the both-surface conveyance path 16 at a position on the opposite side to the reading unit 60. With this configuration, the surface of the recording material P for which the base information is acquired and the surface of the recording material P for which the determination information is acquired can be the same.

Also, in the present embodiment, the non-forming state of the image forming unit is a state in which the developing roller 3 of the image forming unit is in the separated state. However, a discretionary state of the image forming unit for minimizing or preventing toner adhering to the recording material P via fogging also includes the non-forming state. For example, the non-forming state also includes setting the primary transfer roller 6 to the separated state, setting the value of the bias voltage/s used in image forming to a value different from when image forming, and the like. Also, control only needs to be executed so that the toner does not adhere, via fogging, to at least a portion of the recording material P, and control so that toner does not adhere, via fogging, to the entire region of the recording material P is not necessary.

Also, in the present embodiment, the color determination information and the monochrome determination information are acquired during a job, and the base information is acquired during the preparation period after receiving a job. However, by forming an image on the recording material P while the image forming units switch states (forming state/non-forming state) depending on the image pattern to be formed, the color determination information or the monochrome determination information and the base information can be acquired by the reading unit 60 executing reading just once. Specifically, for the margin region of the recording material P, all of the image forming units are set to the non-forming state. Then, in the case of forming a color image, all of the image forming units are set to the forming state for the image forming region, and in the case of forming a monochrome image, the black image forming unit is set to the forming state for the image forming region and other image forming units are not to the non-forming state. Furthermore, in the case of forming an image including a monochrome image and a color image, in a similar manner, the color determination information, the monochrome determination information, and the base information can be acquired by the reading unit 60 executing reading just once.

Also, the image forming apparatus illustrated in FIG. 1 is an intermediate transfer type that uses the intermediate transfer belt 8. However, the present invention may be applied to image forming apparatuses that are not an intermediate transfer type. Specifically, the present invention may be applied to an image forming apparatus in which fogging may occur and a non-forming state can be set, such as an intermediate transfer drum type, an electrostatic conveyance belt type, an electrostatic conveyance drum type, and the like.

Second Embodiment

Next, a second embodiment will be described, focusing on the points that differ from the first embodiment. As described in the first embodiment, in the fogging determination processing, the color determination information, the monochrome determination information, the base information, and reference information are used. Of these, the color determination information, the monochrome determination information, and the base information are acquired via the processing of FIGS. 3 and 4. In other words, the control unit 40, via the processing of FIGS. 3 and 4, keeps updating the color determination information, the monochrome determination information, and the base information.

Figure 6:
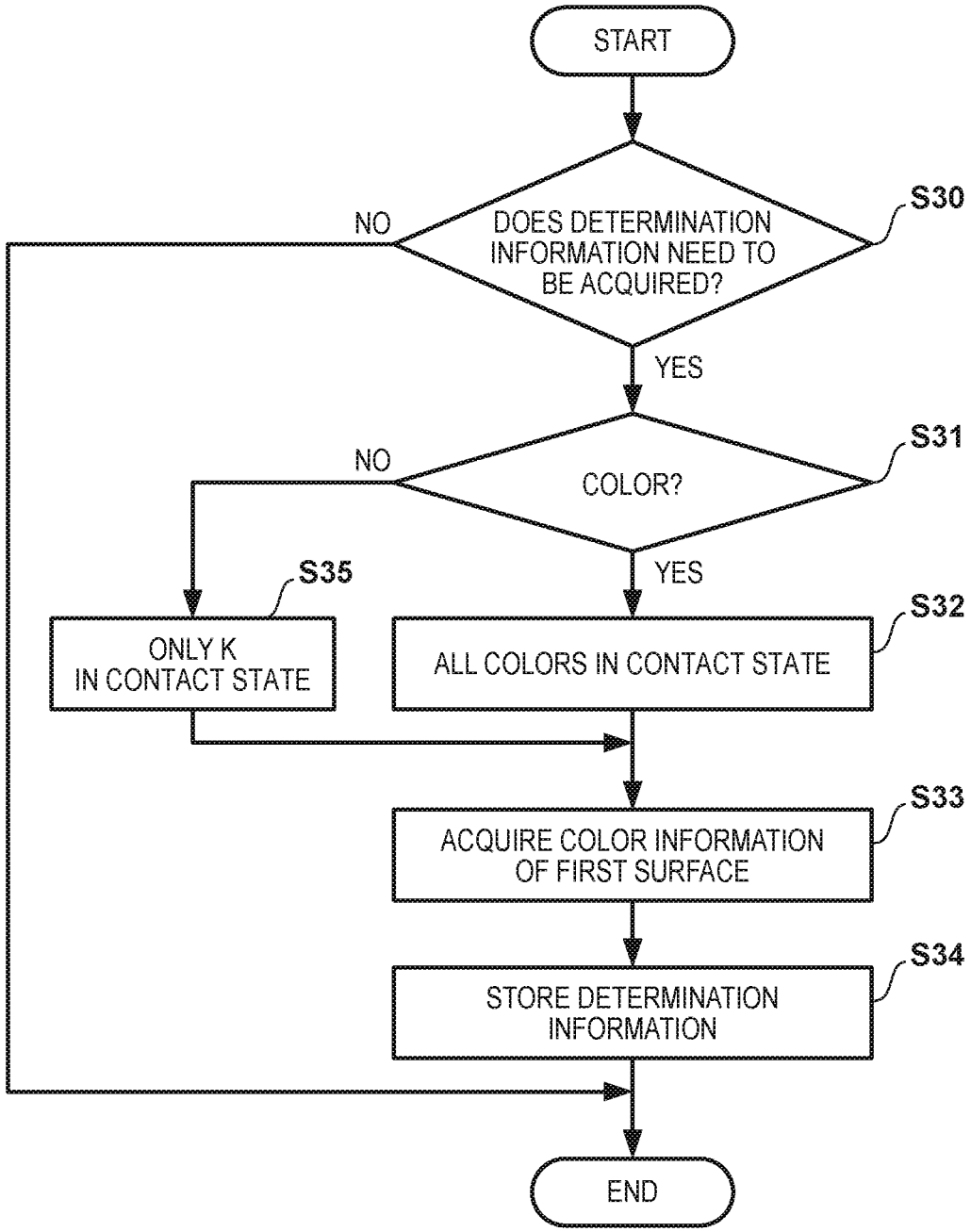
FIG. 6 is a flowchart of processing to acquire determination information according to an embodiment.

Here, to accurately determine the presence of fogging and the color that is the predominant cause of the fogging, the acquisition timing of the color determination information, the monochrome determination information, and the base information are preferably not separated in time. For the base information, for example, the control unit 40 may be configured to determine, in step S10 of FIG. 3, that base information needs to be acquired if an elapsed time from when the base information was last acquired is greater than a predetermined amount of time. This can prevent base information that is too old from being used. However, the determination information acquired in step S25 of FIG. 4 is dictated by the contents of the job. Thus, in some cases the determination information may be too old. For this reason, in the present embodiment, the processing of FIG. 6 is executed. The processing of FIG. 6 is executed before the processing of step S14 in the case in which base information acquisition is determined to be unnecessary (No) in the processing of step S10 of FIG. 3.

In step S30, the control unit 40 determines whether or not determination information needs to be acquired. The control unit 40 determines that determination information needs to be acquired if the elapsed time from when the most recent color determination information or the most recent monochrome determination information currently stored was acquired is greater than a predetermined amount of time. In the case in which determination information acquisition is determined to be not necessary, the control unit 40 ends the processing of FIG. 6. On the other hand, in the case in which determination information acquisition is determined to be necessary, in step S31, the control unit 40 determines whether to acquire the color determination information or to acquire the monochrome determination information. The control unit 40 determines to acquire the color determination information if the elapsed time from when the most recent color determination information stored was acquired is greater than a predetermined amount of time. Also, the control unit 40 determines to acquire the monochrome determination information if the elapsed time from when the most recent monochrome determination information stored was acquired is greater than a predetermined amount of time. Note that in the case in which the elapsed time from when the most recent color determination information and the most recent monochrome determination information were acquired are both greater than a predetermined amount of time, the control unit 40 determines to acquire one determination information.

In the case of acquiring the color determination information, in step S32, the control unit 40 sets all of the developing rollers 3 to the contact state, and in the case of acquiring the monochrome determination information, in step S35, the control unit 40 sets only the black developing roller 3K to the contact state. Then, the control unit 40 conveys the recording material P to the both-surface conveyance path 16 to be read by the reading unit 60. Note that here, the top surface of the photosensitive member 1 of the color with the developing roller in the contact state is charged by the charging roller 2 with the same electric potential as when typically forming an image, but an electrostatic latent image is not formed. In other words, the image forming apparatus is set in a state in which a solid image is formed on the recording material P. In this way, when the recording material P passes the opposing position of the intermediate transfer belt 8, only the toner causing the fogging adheres to the recording material P. Thereafter, in step S33, the control unit 40 makes the reading unit 60 read the color information of the first surface of the recording material P, and, in step S34, the determination information is obtained and stored.

The processing of steps S33 and S34 are similar to the processing of steps S24 and S25 of FIG. 4.

Note that because a job has been received, when the color determination information is to be acquired via the job processing of FIG. 4, the control unit 40 can determine that the color determination information does not need to be acquired via the processing of steps S30 and S31 of FIG. 6. This is the same for the monochrome determination information. Also, a configuration may be employed in which, in step S31, in the case in which the elapsed time from when the color determination information and the monochrome determination information were acquired are both greater than a predetermined amount of time and one determination information is acquired via the processing of FIG. 4, the determination information not acquired via the processing of FIG. 4 is determined to be acquired.

With the configuration described above, the use of determination information with an elapsed time from when acquired greater than a predetermined amount of time can be prevented, thus allowing fogging and the color causing fogging to be accurately determined.

Note that in the present embodiment, in step S31, which determination information to acquire is determined. However, as mentioned in the first embodiment, both determination information can be acquired. Specifically, the recording material P is divided into two regions, with all of the image forming units being set to the forming state for one of the regions and only the black image forming unit being set to the forming state for the other region. With this configuration, the color determination information and the black determination information can be acquired on the basis of a reading result of one sheet of the recording material P by the reading unit 60. Furthermore, in the case in which the base information is acquired via the processing of FIG. 3, in addition to the base information, the color determination information and the black determination information can be acquired. In this case, for example, the recording material P is divided into three regions, with all of the image forming units being set to the forming state for a first region, and only the black image forming unit being set to the forming state for a second region, and all of the image forming units being set to the non-forming state for a third region. With this configuration, the base information, the color determination information, and the black determination information can be acquired on the basis of a reading result of one sheet of the recording material P by the reading unit 60. Furthermore, in a similar manner, two or more from among the base information, the color determination information, and the black determination information can be acquired on the basis of a reading result of one sheet of the recording material P by the reading unit 60. Also, as mentioned in the first embodiment, two or more from among the base information, the color determination information, and the black determination information can be acquired on the basis of a reading result of one sheet of the recording material P by the reading unit 60 by switching the states of the image forming units when forming an image on the recording material.

Third Embodiment

Next, a third embodiment will be described, focusing on the points that differ from the first embodiment and the second embodiment. In the embodiments described above, the monochrome determination information and the color determination information are acquired. Also, to acquire the color determination information, all of the image forming units are set to the forming state. In the present embodiment, only the chromatic color image forming units are set to the forming state and, instead of the color determination information, chromatic color determination information is acquired. In other words, in the present embodiment, the occurrence of fogging and the like is determined using the monochrome determination information and the chromatic color determination information. The present embodiment will be described below using a modified version of the second embodiment as an example of the present embodiment.

Figure 10:
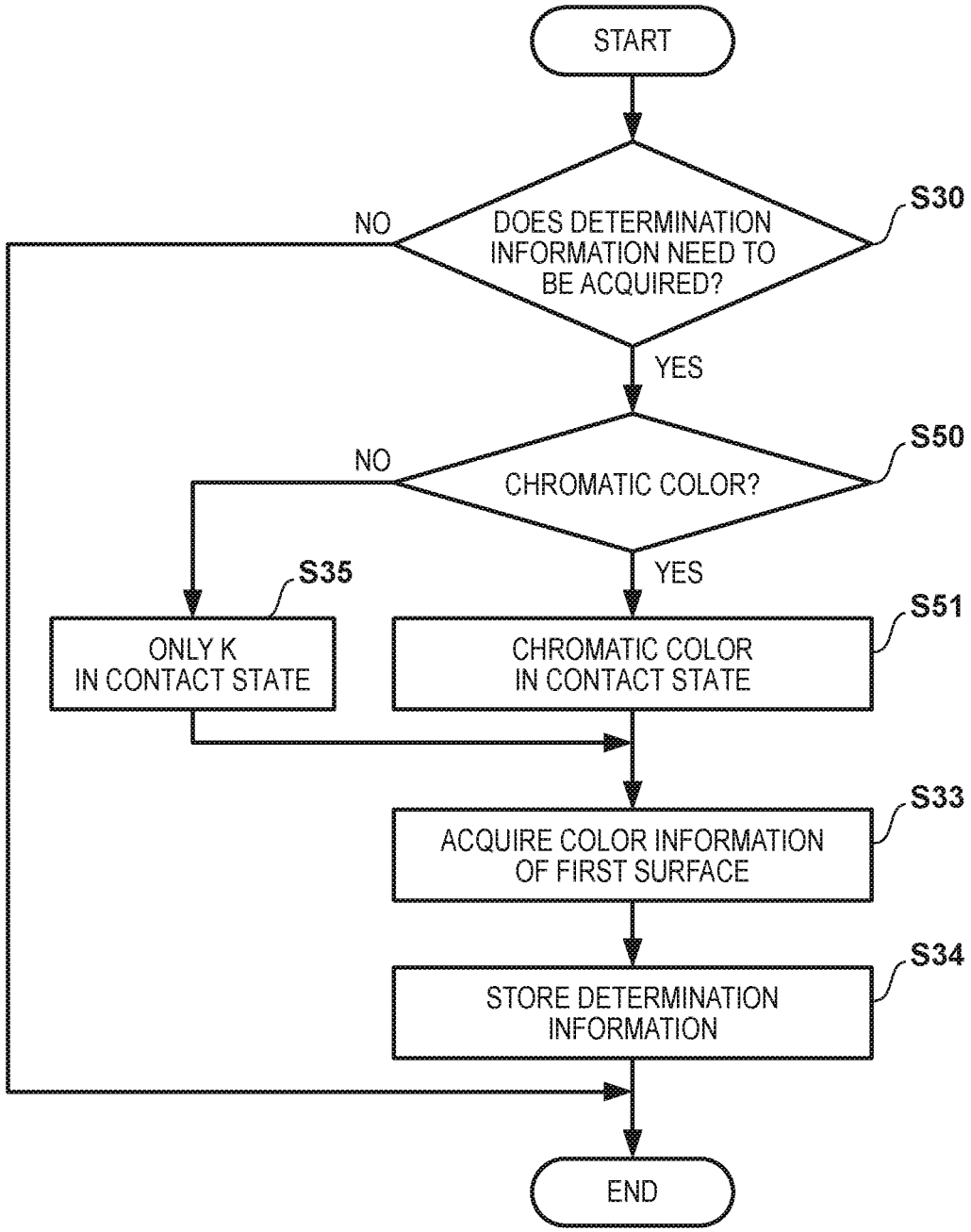
FIG. 10 is a flowchart of processing to acquire determination information according to an embodiment.

FIG. 10 is a flowchart of the processing to acquire the determination information of the present embodiment. Note that steps in the flowchart that are similar to steps in the acquisition processing of the second embodiment illustrated in FIG. 6 are given the same step number and the description thereof is omitted. As with the processing of FIG. 6, the processing of FIG. 10 is executed before the processing of step S14 in the case in which base information acquisition is determined to be unnecessary (No) in the processing of step S10 of FIG. 3. As illustrated in FIG. 10, in the case of acquiring the determination information, in step S50, the control unit 40 determines whether to acquire the chromatic color determination information or to acquire the monochrome determination information. In the case of acquiring the chromatic color determination information, in step S51, the control unit 40 sets only the chromatic color image forming units to the forming state. Note that here, the chromatic color image forming units are set in the state in which a solid image is formed on the recording material P, in a similar manner to that of the second embodiment. In this way, when the recording material P passes the opposing position of the intermediate transfer belt 8, only the toner causing chromatic color fogging adheres to the recording material P. Hereinafter, the chromatic color determination information is referred to as ($R_{ymc}$, $G_{ymc}$, $B_{ymc}$).

When the determination information is acquired, the control unit 40 executes the fogging determination processing described below. Note that the fogging determination processing includes occurrence determination processing, which determines whether or not fogging unacceptable in terms of image quality is occurring, and color determination processing, which determines the color of the toner causing fogging in the case in which fogging is determined to be occurring.

First, the occurrence determination processing will be described. The control unit 40 first, using a method similar to that of the first embodiment, determines the color difference $dE_m$ between the monochrome determination information and the base information. Next, a color difference $dE_{ymc}$ between the chromatic color determination information and the base information is determined. The color difference $dE_{ymc}$ is the Euclidean distance in RGB space and is determined using Formula (8) below.

$$dE_{ymc}=\sqrt{((R_{ymc}-R_0)^2+(G_{ymc}-G_0)^2+(B_{ymc}-B_0)^2)} \quad (8)$$

The color difference $dE_{ymc}$ indicates the density of the fogging caused by the chromatic color toners and is a value correlating to the chromatic color fogging toner amount adhered to the recording material P.

The color difference $dE_m$+the color difference $dE_{ymc}$ indicates the density of the fogging caused by all of the toners and is a value correlating to the fogging toner amount adhered to the recording material P. Thus, in the present embodiment, in the case in which the color difference $dE_m$+the color difference $dE_{ymc}$ is greater than the first threshold, fogging is determined to be occurring, and in other cases, fogging is determined to not be occurring. The first threshold is, as in the first embodiment, 10, for example.

Next, in the case in which fogging is determined to be occurring, the control unit 40 executes the color determination processing. The color determination processing includes a first determination processing and a second determination processing, as in the first embodiment. Note that the first determination processing is also similar to that of the first embodiment.

In the second determination processing of the present embodiment, the chromatic color determination information, the base information, and the reference information are used, but the monochrome determination information is not used. First, the control unit 40 converts the chromatic color determination information ($R_{ymc}$, $G_{ymc}$, $B_{ymc}$) in the RGB color space to chromatic color determination information ($L^*_{ymc}$, $a^*_{ymc}$, $b^*_{ymc}$) in the L*a*b* color space. In a similar manner, the control unit 40 converts the base information ($R_0$, $G_0$, $B_0$) in the RGB color space to base information ($L^*_0$, $a^*_0$, $b^*_0$) in the L*a*b* color space. Note that the reference information is also similar to that of the first embodiment.

The control unit 40 determines a differential vector $D_{k2}$ using Formula (9) below by subtracting a vector in the color space corresponding to the base information from a vector in the color space corresponding to the chromatic color determination information.

$$D_{k2}=(L^*_{k2},a^*_{k2},b^*_{k2})$$

$$=(L^*_{ymc}-L^*_0,a^*_{ymc}-a^*_0,b^*_{ymc}-b^*_0) \quad (9)$$

The differential vector $D_{k2}$ is determined by the color of the base being subtracted from the determination information indicating the chromatic color of the fogging and the color of the base. In other words, the differential vector $D_{k2}$ is color information indicating the color of the fogging caused by the yellow, magenta, and cyan toner. The differential vector Di and the method for determining the color that is the predominant cause of the fogging using the reference vectors are different from that of the first embodiment only in that the differential vector $D_k$ is switched with the differential vector $D_{k2}$.

With the configuration described above, the occurrence of fogging can be determined and the toner color causing the fogging can be determined.

Note that in the present embodiment, the black image forming unit is set to the forming state and the monochrome determination information is acquired, and the chromatic color image forming units are set to the forming state and the chromatic color determination information is acquired. However, a configuration may be employed in which one of the plurality of image forming units is set to the forming state and a single color determination information is acquired and the remaining image forming units are set to the forming state and mixed color determination information is acquired. For example, the control unit 40 selects the image forming unit closest to the end of its service life on the basis of the use history of the image forming units. For example, the control unit 40 may determine the cumulative number of rotations of the rotation body provided in each of the image forming units or the cumulative number of sheets of the recording material used for image forming for each of the image forming units and may determine the image forming unit with the highest cumulative number of rotations or cumulative number of sheets determined to be the image forming unit closest to the end of its service life. Alternatively, in the case in which a maximum value of cumulative number of rotations or cumulative number of sheets is set for the image forming units, the image forming unit with the smallest difference between this maximum value and the current cumulative number of rotations or cumulative number of sheets can be determined to be the image forming unit closest to the end of its service life. The control unit 40 sets only the selected image forming unit to the forming state and acquires the single color determination information. Then, the selected image forming unit is set in the non-forming state, and all of the remaining image forming units are set to the forming state and the mixed color determination information is acquired. Note that in the method of determining the fogging, the monochrome determination information and the chromatic color determination information of the present embodiment are switched with the single color determination information and the mixed color determination information. With such a configuration, whether the fogging is occurring due to the image forming unit closest to the end of its service life can be determined. Furthermore, for the remaining image forming units, the one causing the fogging can be identified as in the first embodiment.

Note that the timing of acquiring the items of determination information may be the same as in the first embodiment. For example, a configuration may be employed in which the monochrome determination information is acquired when the monochrome image is formed, and the chromatic color determination information is acquired when the color image is formed or when the image is formed with only the chromatic color toner. However, in the case in which the chromatic color determination information is acquired when the color image is formed, the black image forming unit is set to the non-forming state for the region where the black toner image of the color image to be formed is not formed. Furthermore, both items of determination information and both the determination information and the base information can be acquired by the reading unit 60 executing reading just once.

Fourth Embodiment

Next, a fourth embodiment will be described, focusing on the points that differ from the first embodiment. In the first embodiment, when a job is received, first, whether or not the base information needs to be acquired is determined, and, in the case in which acquisition is necessary, the base information is acquired before image forming. Thus, the time from when the job is received to when image forming is started is extended. In other words, the time from when the job is received to when image forming is completed is extended. In the present embodiment, to prevent the time from when the job is received to when image forming is completed being extended by the acquisition of the base information, the base information is acquired during a suspension period of image forming. Note that suspension of image forming occurs due to various processing that are necessary during image forming. For example, continuously forming images on a plurality of the recording materials P increases the friction between the cleaner 4 and the photosensitive member 1, which may cause damage to the cleaner 4. The toner functions as a lubricant between the cleaner 4 and the photosensitive member 1. Thus, if a predetermined condition is satisfied during the continuous image forming on a plurality of the recording materials P, the image forming apparatus suspends image forming and executes discharge processing to supply toner from the developing roller 3 to the photosensitive member 1.

The discharge processing is executed with the developing roller 3 set to the contact state. However, by setting the primary transfer roller 6 to the separated state, the cartridges can be set to the non-forming state. Thus, in the present embodiment, the processing to acquire the base information and the discharge processing are executed concurrently. By acquiring the base information in this manner, the time from when the job is received to when image forming is completed being extended can be prevented.

Figure 7:
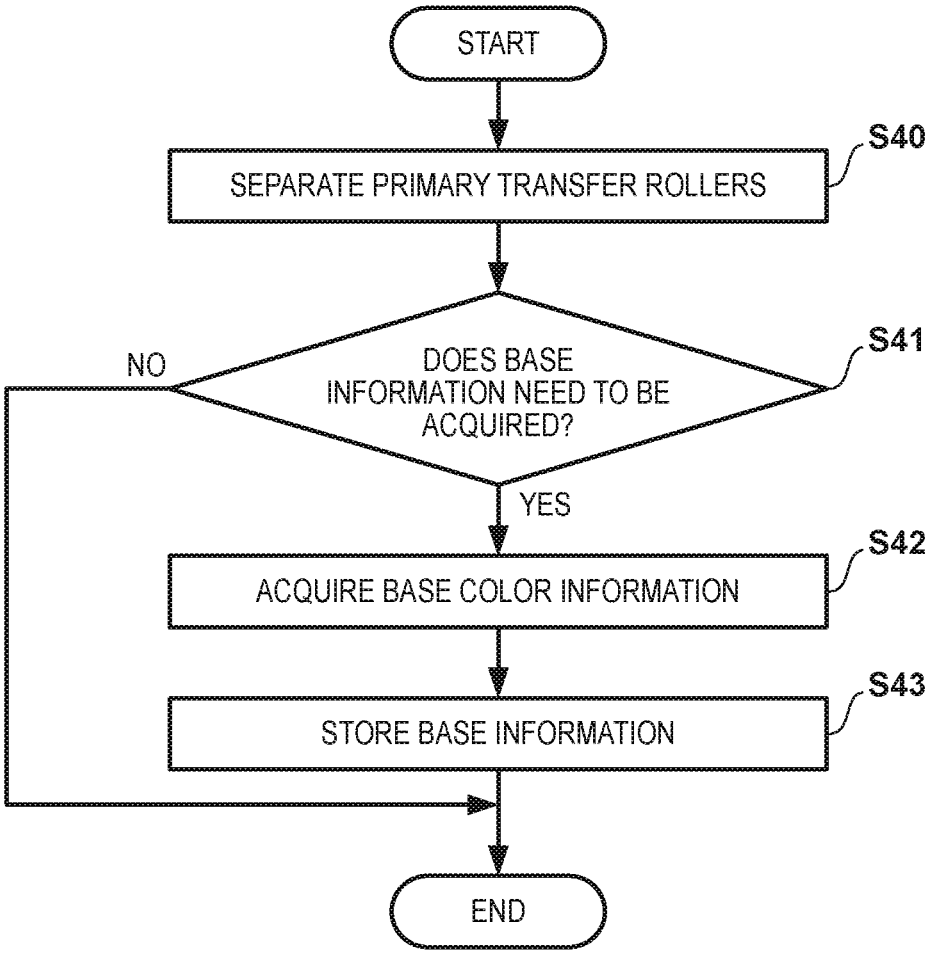
FIG. 7 is a flowchart of processing to acquire base information according to an embodiment.

FIG. 7 is a flowchart of the processing to acquire the base information of the present embodiment. In the present embodiment, when the control unit 40 receives a job, the control unit 40 executes image forming without executing the processing of FIG. 3. Also, when a predetermined condition is satisfied, the control unit 40 suspends image forming and starts executing the discharge processing concurrently with the processing of FIG. 7. In step S40, the control unit 40 sets all of the primary transfer rollers 6 to the separated state. Also, as in step S10 of FIG. 3, in step S41, the control unit 40 determines whether or not base information needs to be acquired. In the case in which base information acquisition processing is not executed, the control unit 40 ends the processing of FIG. 7. On the other hand, in the case in which the processing to acquire the base information is executed, the control unit 40 executes the processing of steps S42 and S43 to acquire the base information. Note that the processing of steps S42 and S43 are similar to the processing of steps S12 and S13 of FIG. 3.

Note that in the present embodiment, the base information is acquired during the suspension period of image forming by executing the discharge processing. However, a configuration may be employed in which the base information is acquired during the suspension period of image forming by executing a different processing in which the image forming apparatus can be set to the non-forming state. For example, in the case in which images are continuously formed on recording materials P of a small size, the temperature of the fixing device 17 may increase unnecessarily. Thus, to minimize or prevent an increase in the temperature of the fixing device 17, image forming is suspended and temperature increase prevention processing is executed. A configuration may be employed in which the base information is acquired while image forming is suspended by executing the temperature increase prevention processing. Also, a configuration may be employed in which the base information is acquired while image forming is suspended to supply toner.

Furthermore, the image forming apparatus may suspend image forming and execute color misregistration correction processing or density correction processing. For example, a configuration may be employed in which the base information is acquired in the image forming suspension period to execute these correction processing. Note that in the color misregistration correction processing and the density correction processing, a detection toner image is formed for detecting the amount of color misregistration and density on the intermediate transfer belt 8. Thus, after the detection toner image is formed, the image forming apparatus is set to the non-forming state and, while the recording material P is passing the opposing position of the intermediate transfer belt 8, without the detection toner image being transferred to the recording material P, the conveyance of the recording material P is controlled and the base information is acquired.

As described above, when processing that needs image forming to be suspended is started to be executed during image forming, the processing is executed concurrently with acquiring the base information. By acquiring the base information in this manner, the time from when the job is received to when image forming is completed being extended can be prevented.

Fifth Embodiment

Next, a fifth embodiment will be described, focusing on the points that differ from the first embodiment. In the first embodiment, in the fogging determination processing, the color determination information, the monochrome determination information, the base information, and reference information are used. Also, the base information is acquired before image forming. Thus, the time from when the job is received to when image forming is started is extended. In other words, the time from when the job is received to when image forming is completed is extended. In the present embodiment, to prevent the time from when the job is received to when image forming is completed being extended, the base information is not acquired and chromatic color fogging determination processing is executed using only the color determination information, the monochrome determination information, and the reference information.

When the determination information is acquired, the control unit 40 executes the fogging determination processing described below. In the fogging determination processing, the most recent color determination information and the most recent monochrome determination information are used. Note that the fogging determination processing includes occurrence determination processing, which determines whether or not chromatic color fogging unacceptable in terms of image quality is occurring, and color determination processing, which determines the color of the chromatic color toner causing fogging in the case in which fogging is determined to be occurring.

First, the occurrence determination processing will be described. The control unit 40 first determines a color difference $dE_k$ between the color determination information and the monochrome determination information. The color difference $dE_k$ is the Euclidean distance in RGB space and is determined using Formula (10) below.

$$dE_k=\sqrt{((R_c-R_m)^2+(G_c-G_m)^2+(B_c-B_m)^2)} \quad (10)$$

The color difference $dE_k$ indicates the density of the fogging caused by the chromatic color toners, excluding the black toner, and is a value correlating to the chromatic color fogging toner amount adhered to the recording material P.

In the present embodiment, when the color difference $dE_k$ is greater than a third threshold, chromatic color fogging is determined to be occurring, and when the color difference $dE_k$ is less than the third threshold, chromatic color fogging is determined to not be occurring. When the color difference $dE_k$ equals to the third threshold, it is possible to determine that chromatic color fogging occurs or it is possible to determine that chromatic color fogging does not occur. With the R, G, B color values represented by 8 bits (from 0 to 255), the third threshold is 5, for example. Note that in the present embodiment, "chromatic color fogging is occurring" means that chromatic color fogging unacceptable in terms of image quality is occurring. In other words, in the present embodiment, a determination that chromatic color fogging is not occurring does not mean that zero fogging is occurring and means that chromatic color fogging unacceptable in terms of image quality is not occurring. Also, the control unit 40 determines higher values of the color difference $dE_k$ as representing chromatic color fogging of higher degrees (higher density of fogging).

In the case in which chromatic color fogging is determined to be occurring, the control unit 40 executes the color determination processing. Note that the color determination processing is similar to the second determination processing described in the first embodiment. In this processing, whether the chromatic color fogging is mainly caused by the yellow toner, caused by the magenta toner, or caused by the cyan toner can be determined.

With this configuration, the occurrence of chromatic color fogging and the color thereof can be accurately determined without the time from when the job is received to when image forming is completed being extended. Note that to discern the fogging density of black toner fogging, a separate dedicated mode may be executed, for example, and the base information may be acquired via the same method in the first embodiment as necessary.

Other Embodiments

Embodiments of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-191154, filed Oct. 18, 2019 and Japanese Patent Application No. 2020-101078, filed Jun. 10, 2020, which are hereby incorporated by reference herein in their entirety.

What is claimed is:

1. An image forming apparatus, comprising:

a plurality of image forming units including a first image forming unit configured to form an image by using a toner of a first color, and a plurality of second image forming units configured to form an image by using toners of a plurality of second colors which are different from one another, wherein the plurality of image forming units are capable of being set in a non-forming state in which an image is not formed or a forming state in which an image is formed;

a reading unit configured to read a surface of a recording material having passed an image forming position where an image is able to be formed on the recording material; and a control unit configured to perform control to acquire first determination information, which is obtained by making the reading unit read a non-image region of the recording material with only the first image forming unit set in the forming state, and acquire second determination information, which is obtained by making the reading unit read the non-image region of the recording material with all of the plurality of image forming units set in the forming state, wherein the control unit is further configured to determine a color of a toner adhered to the non-image region from among the plurality of second colors based on the first determination information, and the second determination information.

2. The image forming apparatus according to claim 1, wherein the control unit is further configured to determine that a toner of at least one color from among the plurality of second colors is adhered to the non-image region in a case in which a difference between the first determination information and the second determination information is greater than a first threshold.

3. An image forming apparatus, comprising:

a plurality of image forming units including a first image forming unit configured to form an image by using a toner of a first color, and a plurality of second image forming units configured to form an image by using toners of a plurality of second colors which are different from one another, wherein the plurality of image forming units are capable of being set in a non-forming state in which an image is not formed or a forming state in which an image is formed;

a reading unit configured to read a surface of a recording material having passed an image forming position where an image is able to be formed on the recording material; and a control unit configured to perform control to acquire base information, which is obtained by making the reading unit read the surface of the recording material with all of the plurality of image forming units set in the non-forming state, acquire first determination information, which is obtained by making the reading unit read a non-image region of the recording material with only the first image forming unit set in the forming state, and acquire second determination information, which is obtained by making the reading unit read the non-image region of the recording material with all of the plurality of image forming units set in the forming state or with only all of the plurality of second image forming units set in the forming state, wherein the control unit is further configured to determine a color of a toner adhered to the non-image region of the recording material based on the base information, the first determination information, and the second determination information.

4. The image forming apparatus according to claim 3, wherein the control unit is further configured to, when a print job is received and a predetermined condition is satisfied, acquire the base information before starting to form an image on the recording material based on the print job.

5. The image forming apparatus according to claim 4, wherein the predetermined condition is satisfied in a case in which the print job is a first print job after a user operation relating to a cassette storing the recording material is detected, in a case in which the print job is a first print job after the image forming apparatus is powered on, or in a case in which an elapsed time from when the base information was acquired is greater than a predetermined amount of time.

6. The image forming apparatus according to claim 3, wherein the control unit is further configured to acquire the base information during a suspension of an image based on a print job being formed.

7. The image forming apparatus according to claim 3, wherein the control unit is further configured to determine whether or not a toner is adhered to the non-image region and, in a case in which a toner is determined to be adhered to the non-image region, determine whether or not a predominant color of the toner adhered to the non-image region is the first color based on the base information and the first determination information.

8. The image forming apparatus according to claim 7, wherein the control unit is further configured to determine that a predominant color of the toner adhered to the non-image region is the first color in a case of a difference between the base information and the first determination information being greater than a first threshold.

9. The image forming apparatus according to claim 8, wherein the control unit is further configured to notify a user of the predominant color determined or adjust an image forming condition of the image forming unit using a toner of the predominant color determined.

10. The image forming apparatus according to claim 7, wherein the control unit is further configured to acquire the second determination information by making the reading unit read the non-image region of the recording material with only all of the plurality of second image forming units set to the forming state, determine a first difference between the first determination information and the base information, determine a second difference between the second determination information and the base information, and determine that a toner is adhered to the non-image region if a sum of the first difference and the second difference is greater than a second threshold.

11. The image forming apparatus according to claim 7, wherein the control unit is further configured to, in a case in which the predominant color of the toner adhered to the non-image region is determined to be not the first color, determine which of the plurality of second colors is the predominant color of the toner adhered to the non-image region based on the second determination information, the base information, and reference information, which is color information of each one of the plurality of second colors.

12. The image forming apparatus according to claim 7, wherein the control unit is further configured to acquire the second determination information by making the reading unit read the non-image region of the recording material with all of the plurality of image forming units set to the forming state, and determine that a toner is adhered to the non-image region in a case in which a difference between the base information and the second determination information is greater than a second threshold.

13. The image forming apparatus according to claim 7, wherein the control unit is further configured to, in a case in which the predominant color of the toner adhered to the non-image region is determined to be not the first color, determine which of the plurality of second colors is the predominant color of the toner adhered to the non-image region based on the first determination information, the second determination information, and reference information, which is color information of each one of the plurality of second colors.

14. The image forming apparatus according to claim 3, wherein each image forming unit of the plurality of image forming units includes a photosensitive member, and a developing unit configured to form an image on the photosensitive member using toner by developing an electrostatic latent image formed on the photosensitive member using toner;

the image forming unit when set to the forming state is in a state in which the image is capable of being formed on the photosensitive member included in the image forming unit; and the image forming unit when set to the non-forming state is in a state in which at least the developing unit included in the image forming unit is separated from the photosensitive member.

15. The image forming apparatus according to claim 3, wherein the control unit is further configured to acquire the first determination information when an image is to be formed on the recording material using only the first image forming unit.

16. The image forming apparatus according to claim 15, wherein a read position of the reading unit is on a both-surface conveyance path along which the recording material is conveyed when an image is to be formed on both sides of the recording material; and the control unit is further configured to acquire the first determination information when an image is to be formed on both sides of the recording material using only the first image forming unit.

17. The image forming apparatus according to claim 3, wherein the control unit is further configured to acquire the second determination information when an image is to be formed on the recording material using all of the plurality of second image forming units.

18. The image forming apparatus according to claim 17, wherein a read position of the reading unit is on a both-surface conveyance path along which the recording material is conveyed when an image is to be formed on both sides of the recording material; and the control unit is further configured to acquire the second determination information when an image is to be formed on both sides of the recording material using all of the second image forming units.

19. The image forming apparatus according to claim 3, wherein the control unit is further configured to, when a print job is received and an elapsed time from when the first determination information was acquired is greater than a predetermined amount of time, acquire the first determination information before starting to form an image on the recording material based on the print job.

20. The image forming apparatus according to claim 19, wherein each image forming unit of the plurality of image forming units includes a photosensitive member, a charging unit configured to charge a surface of the photosensitive member, and an exposure unit configured to expose the surface of the photosensitive member charged by the charging unit to light and form an electrostatic latent image on the photosensitive member; and in a case in which the first determination information or the second determination information is acquired before starting to form an image on the recording material based on the print job, the control unit is further configured to charge the photosensitive member of the image forming unit set to the forming state and to not form the electrostatic latent image on the photosensitive member of the image forming unit set to the forming state.

21. The image forming apparatus according to claim 3, wherein the control unit is further configured to, when a print job is received and an elapsed time from when the second determination information was acquired is greater than a predetermined amount of time, acquire the second determination information before starting to form an image on the recording material based on the print job.

22. The image forming apparatus according to claim 3, wherein the control unit is further configured to, when a print job is received and both an elapsed time from when the first determination information was acquired and an elapsed time from when the second determination information was acquired are greater than a predetermined amount of time, determine whether to acquire, before starting to form an image on the recording material, the first determination information or the second determination information based on the print job.

23. The image forming apparatus according to claim 22, wherein the control unit is further configured to acquire the first determination information before starting to form an image on the recording material based on the print job in a case in which the print job is for forming an image on the recording material using all of the plurality of second image forming units, and acquire the second determination information before starting to form an image on the recording material based on the print job in a case in which the print job is for forming an image on the recording material using only the first image forming unit.

24. The image forming apparatus according to claim 3, wherein the first color is black, and the plurality of second colors include yellow, cyan, and magenta.

25. The image forming apparatus according to claim 3, wherein the control unit is further configured to select the first image forming unit from among the plurality of image forming units based on a use history of each one of the plurality of image forming units.

26. The image forming apparatus according to claim 3, wherein the control unit is further configured to select the first image forming unit based on a cumulative number of rotations of a rotation body included in each image forming unit of the plurality of image forming units or a cumulative number of sheets of recording material used for image forming by each one of the plurality of image forming units.

27. The image forming apparatus according to claim 3, wherein the control unit is further configured to acquire at least two from among the base information, the first determination information, and the second determination information based on a reading result of one sheet of recording material by the reading unit, by switching between states of the plurality of image forming units while conveying the one sheet of recording material and making the reading unit read the non-image region of the one sheet of recording material.

* * * * *